United States Patent [19]

Dickens

[11] Patent Number: 4,953,334

[45] Date of Patent: Sep. 4, 1990

[54] ECONOMY BUILDING PANEL

[75] Inventor: Luther I. Dickens, Radford, Va.

[73] Assignee: RADVA Corporation, Radford, Va.

[21] Appl. No.: 114,048

[22] Filed: Oct. 29, 1987

[51] Int. Cl.[5] ..... E04C 1/00

[52] U.S. Cl. ..... 52/309.4; 52/478; 52/468; 52/541

[58] Field of Search ..... 52/459, 465, 468, 541, 52/527, 478, 221, 592, 309.7, 309.16

[56] References Cited

U.S. PATENT DOCUMENTS

| | | | |
|---|---|---|---|
| 2,142,305 | 1/1939 | Davis . | |
| 2,156,566 | 5/1939 | Kirschbraun | 52/541 |
| 4,241,555 | 12/1980 | Dickens et al. | 52/309.4 X |
| 4,284,447 | 8/1981 | Dickens et al. | 52/309.12 X |
| 4,700,520 | 10/1987 | Ting | 52/478 |

FOREIGN PATENT DOCUMENTS 2136031 9/1984 United Kingdom .

*Primary Examiner*—David A. Scherbel
*Assistant Examiner*—Creighton Smith
*Attorney, Agent, or Firm*—Alvin E. Hendricson

[57] ABSTRACT

A low cost insulating panel for covering walls of existing structures has an expanded cellular core having complementary stepped side edges of differing width to define depressions in a combination of two panels. The panel has thin flat reinforcing strips along side edges extending upon a front face of the panel and therefrom into the stepped configurations at most to come in contact in the depression formed by two mating panels without extending to a back face of any panel.

6 Claims, 2 Drawing Sheets

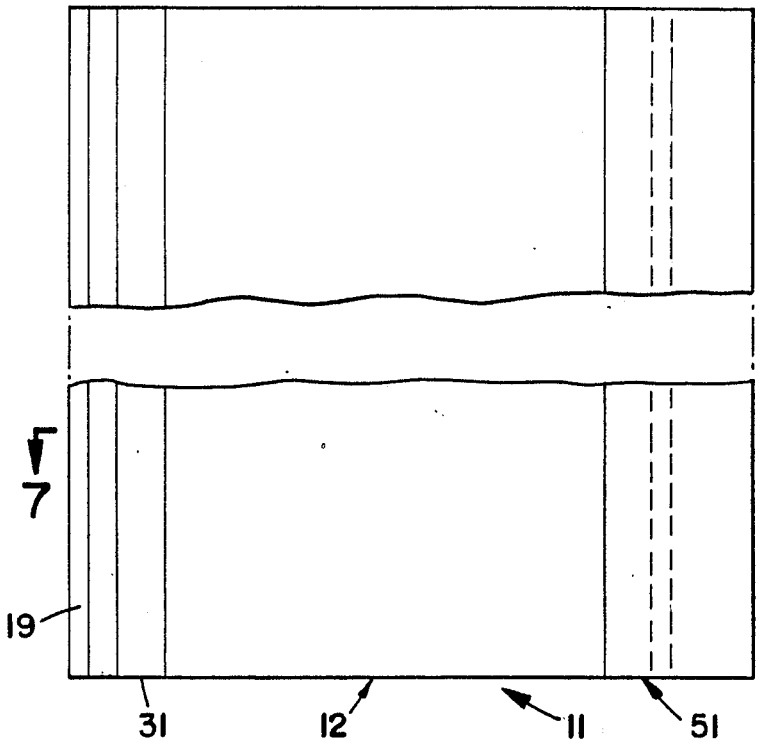
FIG_5
FIG_6
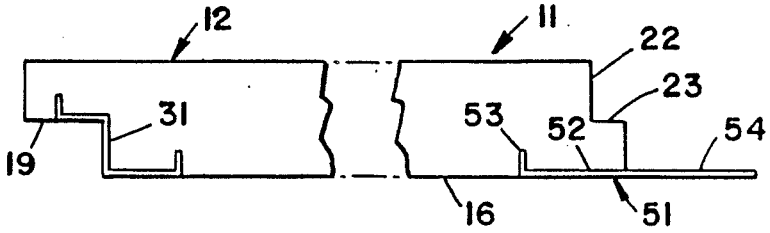
FIG_7
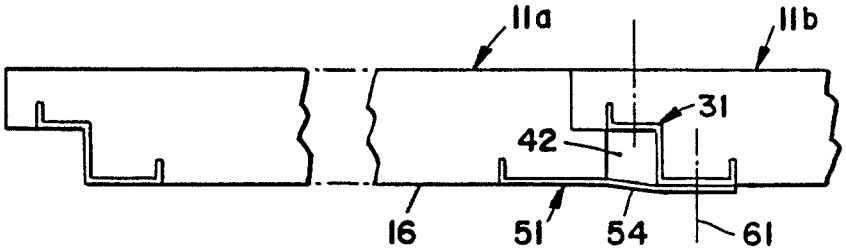
FIG_8

ECONOMY BUILDING PANEL

FIELD OF INVENTION

An insulating building panel has an expanded cellular core with side edge reinforcing strips fitting complementary stepped core edges of different step widths for defining rectangular troughs along edges of mating panels.

BACKGROUND OF INVENTION

The renovation of existing building structures has commonly included the use of various conventional wall coverings such as plywood, plasterboard and the like, however, these conventional panels fail to meet many present day requirements for heat insulation. While it is possible to insulate walls, ceilings and the like by blowing insulation therein, such has proven to be costly and time consuming. There also have been developed and marketed insulating panels which may be employed in the construction of new buildings, and although these panels are equally applicable for use in renovating structures, they normally provide more structural strength than is required for renovation projects and thus are more expensive than necessary for the application.

The present invention provides a simplified and less costly building and insulating panel of the same general type as set forth in U.S. Pat. Nos. 4,241,555 and 4,284,447. While the same basic theory is common to the foregoing patents and the present invention, the latter is particularly directed to minimization of complexity of structure and cost, concomitant with the same end results of a high grade, readily installed insulating panel.

SUMMARY OF INVENTION

The present invention provides a simplified insulating building panel of the type first disclosed in U.S. Pat. No. 4,241,555 and particularly directed, although not limited, to application upon structurally sound walls or the like as, for example, during rebuilding and/or restoration of existing building structures.

The panel hereof is formed of a molded expanded cellular core having at least edge reinforcing strips of thin lightweight metal or the like that are bonded to the core during core formation. The core edges have stepped configurations with one edge having a wider step than the other so that abutting panels define a trough therebetween at a front face of the panels. The reinforcing strips are bonded to portions of the stepped edges at the front face of the core. At least one panel edge may have a strip extending from the core along a vertical edge for overlapping an edge strip of a contiguous panel during panel application for joining panels together and covering the trough therebetween. These panels incorporate or in combination define, transverse and/or longitudinal conduits that are adapted to contain electrical conductors to convenience outlets or the like.

BRIEF DESCRIPTION OF DRAWINGS

The present invention is illustrated with respect to particular preferred embodiments thereof in the accompanying drawings, wherein:

FIG. 5 is a partial plan view of another embodiment of the panel of FIG. 1;

FIG. 6 is a partial end view of the panel of FIG. 5;

FIG. 7 is a partial sectional view taken in the plane 7—7 of FIG. 5; and FIG. 8 is a partial sectional view illustrating the mating of two panels of FIG. 5.

DESCRIPTION OF PREFERRED EMBODIMENT

Figure 1:
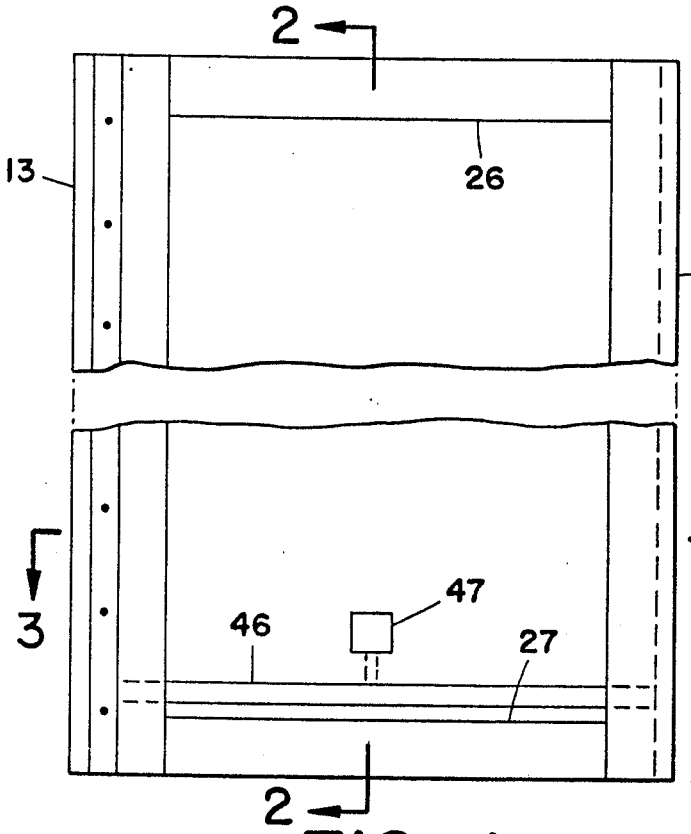
FIG. 1 is a partial plan view of a panel in accordance with the present invention.
Figure 2:
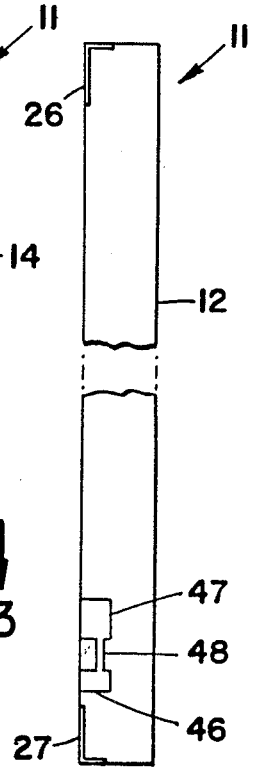
FIG. 2 is a longitudinal central sectional view taken in the plane 2—2 of FIG. 1.
Figure 3:
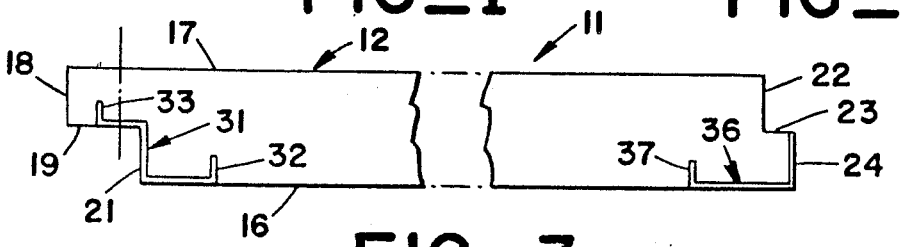
FIG. 3 is an enlarge transverse sectional view taken in the plane 3—3 of FIG. 1.

A building panel in accordance with the present invention is illustrated in FIGS. 1 to 3 and reference is made thereto wherein it will be seen that the panel 11 includes a core 12 formed of expanded cellular material. This core 12 is illustrated in the drawings to have a planner rectangular configuration, however, it will be appreciated that other shapes are possible for particular applications. The core 12 may be formed in a known manner and is preferably formed in a mold.

The panel 11 is also provided with side reinforcing strips 13 and 14 having particular configurations as described below. These side strips 13 and 14 serve as reinforcing members for the panel, and also serve as nailing strips and to define or outline vertical conduits, as also described below.

Edges of the panel 11 are particularly configured as illustrated in FIG. 3 for predetermined abutting relationship of contiguous panels. More particularly, the side edges of the panel have complementary stepped configurations with the step on a first edge having a greater width than the inverted step on a second edge. Thus, abutting a pair of panels with the first edge of one against the second edge of another produces a trough in the front face of the combination along the joinder of panels. The panel 11 is illustrated to be formed with planar front and back surfaces or faces 16 and 17, respectively, with vertical lateral edges having inset or stepped portions as described below. As shown in FIG. 3, for example, the panel 11 has a left vertical edge surface 18 perpendicular to the back surface 17 and extending forwardly therefrom a distance of one-half of the thickness of the panel, for example. A vertical surface 19 extends inwardly of the panel 11 from the forward edge of the surface 18 and a further vertical surface 21 extends forwardly of the panel from the inner edge of the surface 19 to the front 16 of the panel. This then will be seen to defined a stepped configuration and in one preferred embodiment of the present invention the lateral extent of the surface 19 may be about equal to three-quarters of the thickness of the panel between front and back surfaces 16 and 17.

The opposite vertical edge of the panel 11 will be seen to be provided with a vertical surface 22 extending forwardly from the back surface 17 in perpendicular relationship thereto and having a width equal to the vertical surface 18 at the opposite edge of the panel. This right side of the panel of FIG. 3 also includes a vertical surface 23 extending parallel to the front and back surfaces of the panel in extension outwardly from the inner edge of surface 22 and in the illustrated embodiment of the present invention this surface 23 has a lateral width of about one-quarter of the thickness of the panel 11 between the front and back surfaces thereof. A further vertical surface 24 extends forwardly from the outer edge of the surface 23 to the front face 16 of the panel. This right edge configuration will also be seen to provide a stepped configuration.

The improved panel of the present invention includes, in addition to the above described core thereof, certain reinforcing strips which are provided along the vertical lateral edges thereof as described below and may also include transverse strips 26 and 27 extending across the top and bottom of the front face 16 of the panel. These lateral reinforcing strips are optional and in addition thereto there may be provided one or more central reinforcing strips if desired or required for additional strength of the panel.

Considering now, the reinforcing strip at the left edge of the panel, and referring again to FIG. 3 of the drawings there will be seen to be provided a thin angled reinforcing strip 31 covering the edge surface 21 and extending some distance along the front surface 16 and about two-thirds of the width of the surface 19. It will be see that the strips 31 extend laterally on the surface 19 a distance substantially equal to the difference in widths of the steps 23 and 19 at opposite edges of the panel. This ensures covering the floor of a trough formed by abutting panels hereof with a minimum of reinforcing material. Preferably this reinforcing 31 strip also includes bent over end edges 32 and 33 which extend into the core 12, as shown. Such a reinforcing strip 31 is bonded by an adhesive to the core during molding thereof in a heated mold during core formation so that the edges 31 and 32 extend into the core to lock the reinforcing strip 31 to the core. The offset configuration of the reinforcing strip 31 provides the equivalent of a vertical column which stiffens the panel.

At the opposite or right side of the panel 11, as illustrated in FIG. 3, there is provided another vertical reinforcing strip 36 having a portion covering the vertical edge surface 24 of the panel and a right angled front portion extending along the front surface 16 of the panel, with an edge of the latter being turned into the panel as indicated at 37. This reinforcing strip 36 is also integrally formed with the core 12 during the molding operation of the latter so that the strip is permanently bonded to the core with the inturned edge 37 further locking the strip to the core. It is additionally noted in this respect that an appropriate adhesive system is employed during the above noted molding operation to ensure permanent bonding of the strips and core.

It will be seen from the foregoing description of the panel hereof that such panel includes complementary stepped vertical side edges with one edge having a greater indentation or step width than the other. In addition, it will be seen that vertical edge reinforcing strips are provided along both sides in predetermined relationship to the indented or stepped configurations thereof. There may be also provided as a portion of the panel of the present invention certain means defining a lateral conduit or depression for the deposition of electrical conductors or the like together with electrical receptacles following application of the panel to structure members. Such additions are further described below.

Figure 4:
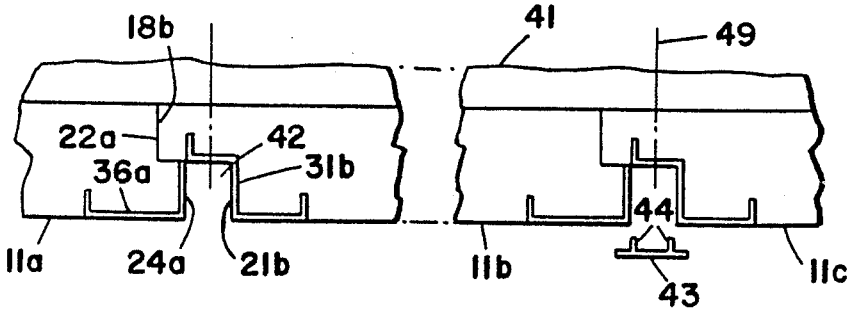
FIG. 4 is a partial transverse sectional view taken in the plane of FIG. 3 and showing the mating of contiguous panels.

Considering now, the application of the present invention to some type of structural wall such as vertical studs or the like, particularly during rehabilitation or renovation of buildings, reference is made to FIG. 4. In FIG. 4, there is illustrated the relationship of successive panels 11*a*, 11*b* and 11*c*, particularly regarding the abutting of same along vertical edges of the panels. In this figure, the surfaces of the panel 11 of FIG. 3 are identified with postscripts a, b, or c in accordance with the particular panel 11*a*, 11*b*, or 11*c* as illustrated in FIG. 4.

It is first noted that some type of structure is intended to be covered by the panels of the present invention and same is herein schematically identified at 41 of FIG. 4. The panels 11*a* and 11*b* of FIG. 4 are abutted along vertical edges thereof as indicated in FIG. 4 wherein the vertical edge 22*a* of panel 11*a* abutts the vertical edge 18*b* of the panel 11*b*. This will then place the vertical edge 24*a* of panel 11*a* in spaced relationship to the vertical edge 21*b* of the panel 11*b* to define a vertical trough or depression 42 of rectangular cross section extending between top and bottom of the two panels 11*a* and 11*b* between adjacent edges thereof. This vertical trough or depression 42 will be seen to be lined by the metal strips 31*b* and 36*a*. The difference in lateral extent of the edge surfaces 19*b* and 23*a* determine the width of the trough 42 and this may for example, equal one-half of the depth of the panel 11. Inasmuch as the reinforcing strip 31*b* extends substantially one-third of the width of the surface 19*b*, the two strips 36*a* and 31*b* substantially abutt, as shown in FIG. 4, so that the trough 42 is in fact surrounded on three sides by reinforcing strips. It is particularly noted that the reinforcing strips do not extend through the panels or combinations of panels. The strips extend upon the front face of the panels and partially back along the side edges but do not extend to the back face. This configuration precludes high conductivity heat paths through the panels and thus ensures the desired insulating properties of the panels.

It will also be seen that the same arrangement occurs at the right edge of panel 11*b* whereat the panel 11*c* is disposed in abutting relationship thereto. Thus, along each vertical side edge of each panel 11, there is provided a vertical trough or depression extending from the top to the bottom of the panel. This trough or depression is available to contain electrical conducts or possibly pipes or the like for other uses in the ultimate structure incorporating panels in accordance with the present invention. These depressions or troughs 42 may be closed by the application of caps or strips 43 having small vertical ridges or the like 44 on the back sides thereof adapted to snap into the trough for removably retaining these caps in closing relationship to the trough over the length thereof.

Various additions may be made to the basic panel described above, such as a transverse groove or trough that may extend between the sides of the panel. In this respect it is noted that a U-shaped member 46 may be inset in the front face 16 of the panel in extension laterally thereacross and having an open front for providing access to the trough thereby defined from such front face. This U-shaped member or trough 46 is shown in FIG. 1 to extend between the edge reinforcing strips 31 and 36 and openings may be made in the side strips 31 and 36 to provide communication between the trough 46 and the vertical depressions or troughs 42 of adjacent contiguous panels. The trough 46 may be molded in the core during formation of the latter, and in addition, there may be provided receptacle boxes 47 formed in the core during molding and having connections 48 to the trough 46. There will be seen to be provided in this manner integral troughs or depressions in the panel and combination of panels for later insertion of electrical conduits or the like and, of course, the trough 46 may be covered in the same manner as the vertical trough 42, with appropriate cover plates covering the receptacle boxes 47.

The improved panels of the present invention may be attached to existing structures of various types by the use of nails, preferably inserted through reinforcing strips of the improved panel hereof. In this respect, it is indicated in FIG. 4 that nails may be driven through the back portion of the reinforcing strips 31 as indicated by the center lines 49, for example. Other attachments means such as adhesive and nails through other portions of reinforcing strips, and in fact through other reinforcing strips may also be employed.

An alternative embodiment of the present invention is illustrated in FIGS. 5 through 8 wherein the core 12 will be seen to be the same as the core described above in connection with FIGS. 1 through 3. In this instance, the left side or edge reinforcing strip 31 is also identical the one described above and illustrated in FIG. 3. The variation from the foregoing embodiment occurs in the right side reinforcing strip 51 which is shown in FIG. 7 to comprise a planar strip 51 having a first portion 52 bonded to the right vertical side of the front face 16 of the core with an inturned edge 53 extending into the core and an extension 54 extending laterally outwardly from the front face 16 in parallel relationship thereto. This portion 54 of the reinforcing strip 51 extends a distance substantially greater than the difference between the width of the surfaces 19 and 23 and in the illustrated embodiment this strip portion 54 extends a distance somewhat greater than to the width of the core 12.

Although the end result of mounting panels in accordance with FIGS. 5 through 8 on a wall or the like is substantially the same as described above, it will be seen from FIG. 8 that abutting of contiguous panels 11*a* and 11*b* causes the reinforcing strip extension 54 to extend over the trough 42 defined by the panels and also over a portion of the front surface of the adjacent panel 11*b*. This arrangement provides for closing of the trough 42 as the panels are mounted in abutting relationship upon a wall or the like. While this structure does require insertion of electrical conduits or the like in the trough 42 prior to abutting of adjacent panels or, alternatively, threading same through the closed trough, it has the advantage of closing the trough so that no additional cap or cover is necessary at a later stage of wall completion. Nails, screws or the like may be employed to join the outer edge of the reinforcing portion 54 to the reinforcing strip 31 of an adjacent panel, as indicated by the center line 61.

It will, of course, be appreciated that lateral troughs or the like may be also provided in the panel of FIGS. 5 through 8 in the manner described above with respect to the embodiment of FIGS. 1 through 3. Similarly, transverse reinforcing strips may be employed in this embodiment if desired.

The above described building panel of the present invention will be seen to be highly advantageous in providing a truly insulating panel particularly adapted for attachment to existing structures with a material saving in cost because the simplified panel structure. Additionally, the panels hereof are adapted to defined conduits or troughs for the disposition of further elements such as electrical conductors or piping in the resultant wall. Very substantial savings in the cost of rehabilitating existing structures may be realized by use of the present invention. It is noted that the reinforcing strips of insulated building panels such as described herein are normally formed of stainless steel, for example, or at least some type of thin sheet metal. It will appreciated that the saving in footage of reinforcing material provides a substantial decrease in the cost of the resultant panel. Thus, for example, a standard eight foot by four foot panel of the general type improved upon herein requires some seventy feet of reinforcing strips, while a panel in accordance with the present invention requires only about twenty-eight feet. By conservation calculations, a building panel in accordance with the present invention provides a reduction in material cost of more than fifty percent over conventional building panels of the same general type. The present building panel will thus be seen to provide a material advancement in the art commending it to widespread commercial application.

Although the present invention has been described with respect to particular preferred embodiments thereof, it will be appreciated by those skilled in the art that numerous modifications and variation may be made within the spirit and scope of the present invention and thus it is not intended to limit the invention to the precise terms of description or details of illustration.

What is claimed is:

1. An improved insulating building panel comprising an expanded cellular core with substantially parallel front and back faces, said core having first and second side edges with complementary stepped configurations with a first edge having a wider step than the second edge, and thin reinforcing strips bonded to the front face of said core adjacent said side edges with the strip on the first edge extending along the lateral step surface a distance substantially equal to the difference in width of said steps at said first and second edges.

2. The panel of claim 1 further defined by the reinforcing strip at said second edge extending over the depth of the step at said edge and terminating at the lateral step surface.

3. The panel of claim 1 further defined by the reinforcing strip at said second edge extending laterally from the core edge a distance in excess of the difference in width of said steps at said first and second edges for extending over a trough formed by abutting like panels.

4. The combination of two building panels with each having an expanded cellular core with front and back faces and first and second side edges, said side edges of each panel having complementary stepped configurations with the step of the first edge being wider than the step of the second edge, said panels being disposed in side-by-side relation with a first edge of one panel abutting a second edge of the other panel to define a single trough therebetween from the front faces of said panels, and reinforcing strips bonded to said panels along the first and second edges on the front face of each panel and together extending upon said edges no further than the depth and width of said trough.

5. The combination of claim 4 further defined by the reinforcing strip at said first edge of each of said panels extending from said first face thereof onto the step thereof for a lateral distance substantially equal to the difference in width of the steps at said first and second edges and the strip at said second edge of each of said panels extending from said first face onto said edge only to said step thereat, whereby said trough is lined with reinforcing strips that do not extend through the panels.

6. The combination of claim 4 further defined by the reinforcing strip on the front face of a panel along the second edge thereof extending laterally from the core a distance greater than the difference in widths of the steps of said first and second edge for overlaying and closing said trough between said abutting panels.

* * * * *